US008605023B2

(12) United States Patent
Song et al.

(10) Patent No.: US 8,605,023 B2
(45) Date of Patent: Dec. 10, 2013

(54) APPARATUS AND METHOD FOR DRIVING LIQUID CRYSTAL DISPLAY DEVICE

(75) Inventors: Hong Sung Song, Gumi-si (KR); Oh Hyun Lee, Gimcheon-si (KR); Woong Ki Min, Buk-gu (KR); Hyuk Jin Kim, Daejeon-si (KR)

(73) Assignee: LG Display Co., Ltd., Seoul (KR)

( * ) Notice: Subject to any disclaimer, the term of this patent is extended or adjusted under 35 U.S.C. 154(b) by 783 days.

(21) Appl. No.: 11/646,667

(22) Filed: Dec. 28, 2006

(65) Prior Publication Data

US 2008/0001890 A1 Jan. 3, 2008

(30) Foreign Application Priority Data

Jun. 30, 2006 (KR) ..... P2006-061529

(51) Int. Cl.
*G09G 3/36* (2006.01)

(52) U.S. Cl.
USPC ..... 345/96; 345/99

(58) Field of Classification Search
USPC ..... 345/96
See application file for complete search history.

(56) References Cited

U.S. PATENT DOCUMENTS 6,219,019 B1 * 4/2001 Hasegawa et al. ..... 345/96
6,335,718 B1 * 1/2002 Hong et al. ..... 345/98
2004/0070581 A1 * 4/2004 Hiraki et al. ..... 345/209
2004/0263452 A1 * 12/2004 Kim ..... 345/87
2006/0050038 A1 * 3/2006 Cheon et al. ..... 345/89

FOREIGN PATENT DOCUMENTS

JP 2002-196735 7/2002
KR 1020000029282 A 5/2000

OTHER PUBLICATIONS

Office Action issued in corresponding Korean Patent Application No. 10-2006-0061529, mailed Aug. 8, 2012.

* cited by examiner

*Primary Examiner* — Amr Awad
*Assistant Examiner* — Stephen Bray
(74) *Attorney, Agent, or Firm* — Brinks Gilson & Lione

(57) ABSTRACT

An apparatus and method for driving an LCD device is disclosed, in which an inversion method of an LCD panel is changed depending on a specific pattern of image data so as to improve picture quality of images displayed on the LCD panel. The apparatus for driving an LCD device includes an LCD panel displaying images, a polarity control signal generator comparing image data with pattern data previously stored for the unit of frame and generating a polarity control signal in accordance with the compared result, a data driver converting an inversion method in accordance with the polarity control signal and supplying the received image data to the LCD panel, a gate driver supplying scan pulses to the LCD panel, and a timing controller controlling the data driver and the gate driver.

13 Claims, 5 Drawing Sheets

FIG. 6A

| | | | | | | | | | | | | | | |
|---|---|---|---|---|---|---|---|---|---|---|---|---|---|---|
| R | G | B | R | G | B | R | G | B | R | G | B | R | G | B |
| + | − | + | − | + | − | + | − | + | − | + | − | + | − | + |
| − | + | − | + | − | + | − | + | − | + | − | + | − | + | − |
| + | − | + | − | + | − | + | − | + | − | + | − | + | − | + |
| − | + | − | + | − | + | − | + | − | + | − | + | − | + | − |

FIG. 6B

| | | | | | | | | | | | | | | |
|---|---|---|---|---|---|---|---|---|---|---|---|---|---|---|
| R | G | B | R | G | B | R | G | B | R | G | B | R | G | B |
| + | − | + | − | + | − | + | − | + | − | + | − | + | − | + |
| + | − | + | − | + | − | + | − | + | − | + | − | + | − | + |
| − | + | − | + | − | + | − | + | − | + | − | + | − | + | − |
| − | + | − | + | − | + | − | + | − | + | − | + | − | + | − |

FIG. 6C

| R | G | B | R | G | B | R | G | B | R | G | B | R | G | B |
|---|---|---|---|---|---|---|---|---|---|---|---|---|---|---|
| + | + | − | − | + | + | − | − | + | + | − | − | + | + | − |
| − | − | + | + | − | − | + | + | − | − | + | + | − | − | + |
| + | + | − | − | + | + | − | − | + | + | − | − | + | + | − |
| − | − | + | + | − | − | + | + | − | − | + | + | − | − | + |

FIG. 6D

| R | G | B | R | G | B | R | G | B | R | G | B | R | G | B |
|---|---|---|---|---|---|---|---|---|---|---|---|---|---|---|
| + | + | − | − | + | + | − | − | + | + | − | − | + | + | − |
| + | + | − | − | + | + | − | − | + | + | − | − | + | + | − |
| − | − | + | + | − | − | + | + | − | − | + | + | − | − | + |
| − | − | + | + | − | − | + | + | − | − | + | + | − | − | + |

APPARATUS AND METHOD FOR DRIVING LIQUID CRYSTAL DISPLAY DEVICE

This application claims the benefit of the Korean Patent Application No. 1-2006-061529, filed on Jun. 30, 2006, which is hereby incorporated by reference as if fully set forth herein.

BACKGROUND OF THE INVENTION

1. Field of the Invention

The present invention relates to an apparatus and method for driving a liquid crystal display (LCD) device, in which an inversion method of an LCD panel is changed depending on a specific pattern of image data so as to improve picture quality of images displayed on the LCD panel.

2. Discussion of the Related Art

Generally, an LCD displays images by controlling light transmittance of a liquid crystal having dielectric anisotropy using an electric field. To this end, the LCD device includes an LCD panel having pixel regions arranged in a matrix arrangement and a drive circuit for driving the LCD panel.

The LCD panel includes a plurality of gate lines, a plurality of data lines, and pixel regions, wherein the gate lines are arranged to cross the data lines and the pixel regions are disposed in regions defined by vertically crossing the gate lines and the data lines. The LCD panel further includes pixel electrodes and common electrodes formed to apply an electric field to each of the pixel regions. Each of the pixel electrodes is connected to a thin film transistor (TFT) which serves as a switching device. The TFT is turned on by scan pulses of the gate lines so that data signals of the data lines are charged in the pixel electrodes.

The driving circuit includes a gate driver for driving the gate lines, a data driver for driving the data lines, a timing controller supplying control signals for controlling the gate driver and the data driver, and a common voltage generator supplying a common voltage to the LCD panel.

In the aforementioned LCD device, various inversion driving methods are used to drive the liquid crystal cells on the LCD panel, such as frame inversion, line-column inversion, and dot inversion.

In the frame inversion driving method, the polarity of the data signals supplied to the liquid crystal cells on the LCD display panel is inverted whenever a frame is changed. In the line-column inversion driving method, the polarity of the data signals supplied to the liquid crystal cells is inverted according to the line (column) on the LCD panel. In the dot inversion driving method, a data signal is supplied to each liquid crystal cell of the LCD panel, wherein the data signal has a polarity contrary to the data signal supplied to adjacent liquid crystal cells along vertical and horizontal directions. In addition, in the dot inversion driving method, the polarity of the data signals supplied to all the liquid crystal cells on the LCD panel is inverted for each frame.

Among the various inversion driving methods, the dot inversion driving method provides excellent picture quality, as compared to the frame and line-column inversion methods. According to the inversion driving method, the data driver responds to a polarity control signal supplied from the timing controller to the data driver.

In the dot inversion driving method, as shown in FIG. 1, a pixel voltage of positive polarity or negative polarity is repeatedly applied to the liquid crystal cell in a direction of the gate lines of the LCD panel, and data levels of black (B), white (W), B, W, . . . , or W, B, W, B, . . . are repeatedly displayed. In this case, a defect in picture quality, such as greenish and crosstalk, occurs due to distortion of the common voltage in a dot pattern such as a windows shutdown pattern.

In more detail, in the dot inversion driving method, as shown in FIG. 2, a data voltage of positive polarity (+) and a data voltage of negative polarity (−) are repeatedly supplied for the unit of one horizontal line. In this case, if the data voltage of positive polarity (+) is supplied more than the data voltage of negative polarity (−) during display of white or black, the common voltage Vcom is changed to positive polarity (+).

As the data voltage has the aforementioned polarity pattern, the data voltage of positive polarity (+) and the data voltage of negative polarity (−) supplied to one horizontal line (one gate line) are different from each other in their output range. For this reason, the common voltage Vcom becomes unbalanced. As a result, the common voltage is swung (Vcom-swing) toward the data voltage of positive polarity (+) or the data voltage of negative polarity (−) for the unit of one horizontal line. Also, as shown in FIG. 2, the liquid crystal cell of green (G) becomes relatively brighter than the liquid crystal cell of red (R) and the liquid crystal cell of blue (B), whereby a greenish color occurs on the LCD panel.

Such a greenish color on the LCD panel may occur in two-dot inversion driving method in accordance with the polarity pattern of the data voltage.

SUMMARY

An apparatus for driving an LCD device includes an LCD panel displaying images, a polarity control signal generator that compares image data with pattern data previously stored for the unit of frame and generates a polarity control signal in accordance with the compared result. A data driver converts an inversion method in accordance with the polarity control signal and supplies the received image data to the LCD panel. A gate driver supplies scan pulses to the LCD panel. A timing controller controls the data driver and the gate driver.

In another aspect of the present invention, a method for driving an LCD device includes storing pattern data of image data, comparing currently input image data with the stored pattern data and generating a synchronizing signal in accordance with the compared result. A polarity control signal is generated in accordance with the synchronizing signal. The currently input image data is output synchronized with the polarity control signal.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings:

FIGS. 6A to 6D illustrate an inversion method according to a polarity control signal.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 3:
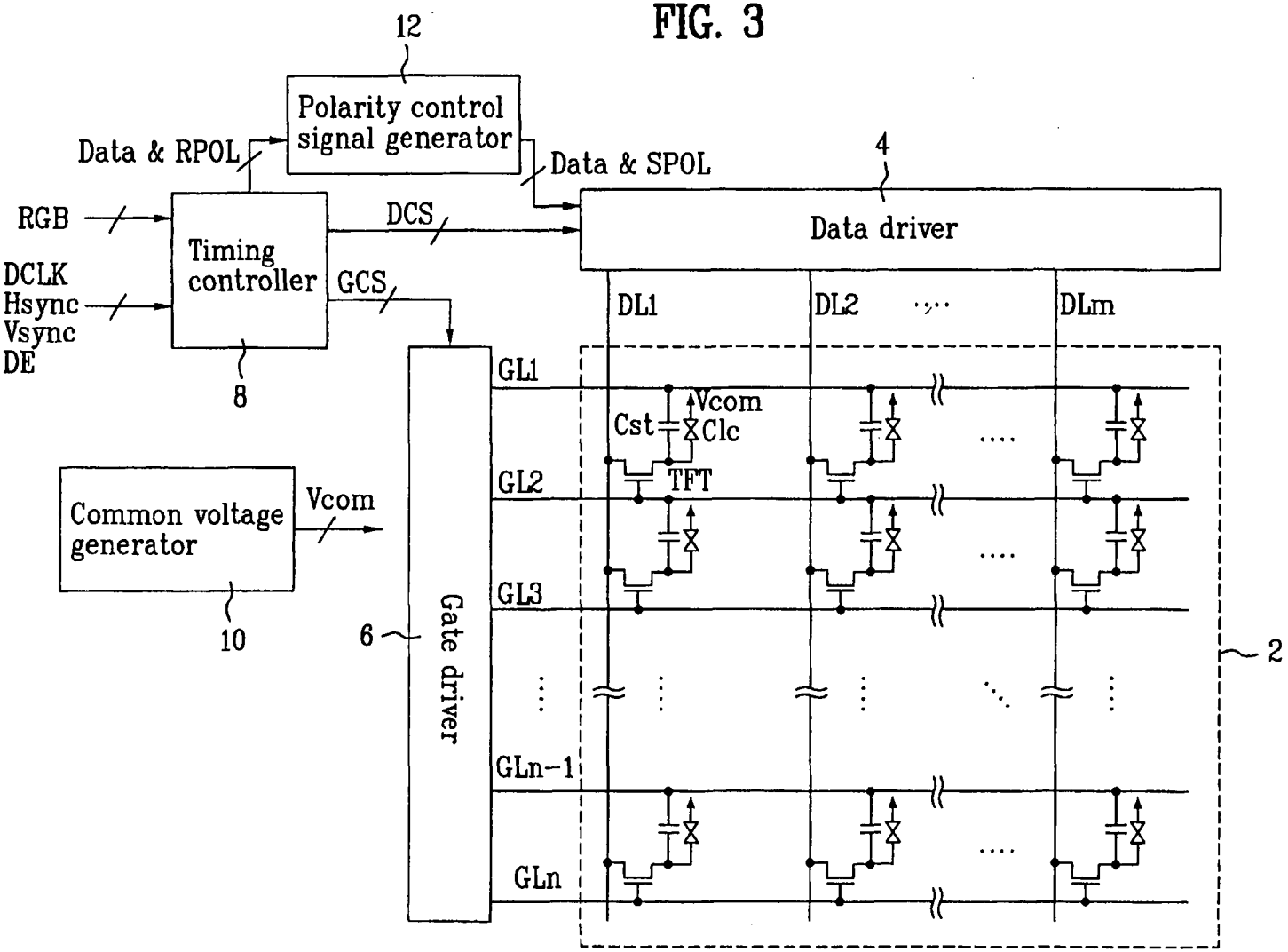
FIG. 3 is a schematic view illustrating an LCD device according to the embodiment of the present invention.

FIG. 3 is a schematic view illustrating an LCD device according to the embodiment of the present invention.

The LCD device shown in FIG. 3 includes an LCD panel 2 having a plurality of data lines DL1 to DLm and a plurality of gate lines GL1 to GLn, a data driver 4 driving the data lines DL1 to DLm, a gate driver 6 driving the gate lines GL1 to GLn, a timing controller 8 controlling the data driver 4 and the gate driver 6, a common voltage generator 10 generating a common voltage Vcom supplied to the LCD panel 2, and a polarity control signal generator 12 comparing image data Data from the timing controller 8 with a previously stored specific pattern and generating a polarity control signal SPOL depending on the compared result.

The LCD panel 2 includes a TFT formed in each pixel region defined by the gate lines GL1 to GLn and the data lines DL1 to DLm, and a liquid crystal capacitor Clc connected to the TFT. The liquid crystal capacitor Clc includes a pixel electrode connected to the TFT, and a common electrode facing the pixel electrode by interposing a liquid crystal therebetween. The TFT supplies data signals from the data lines DL1 to DLm to the pixel electrode in response to scan pulses from the gate lines GL1 to GLn. The liquid crystal capacitor Clc charges a differential voltage between the data signals supplied to the pixel electrode and the common voltage supplied to the common electrode and varies arrangement of liquid crystal molecules in accordance with the differential voltage to control light transmittance, thereby obtaining a gray level. A storage capacitor Cst is connected to the liquid crystal capacitor Clc in parallel so that the voltage charged in the liquid crystal capacitor Clc is maintained until the next data signal is supplied. The storage capacitor Cst is formed in such a manner that the pixel electrode overlaps a previous gate line by interposing an insulating film therebetween. Alternatively, the storage capacitor Cst may be formed in such a manner that the pixel electrode overlaps a storage line by interposing an insulating film therebetween.

The data driver 4 converts digital image data Data from the polarity control signal generator 12 into analog image data in accordance with data control signals DCS from the timing controller 8. Also, the data driver 4 converts an inversion method of the LCD panel 2 in accordance with the polarity control signal SPOL from the polarity control signal generator 12 and supplies to the data lines DL1 to DLm the analog image data corresponding to one horizontal line per one horizontal period in which the scan signals are supplied to the gate lines GL1 to GLn. In other words, the data driver 4 selects a gamma voltage having a predetermined level in accordance with a gray level value of the analog image data and supplies the selected gamma voltage to the data lines DL1 to DLm.

The gate driver 6 includes a shift register that sequentially generates scan pulses, i.e., gate high pulses, in response to the gate control signals GCS from the timing controller 8.

The timing controller 8 aligns externally input image data RGB to be suitable for driving of the LCD panel 2 and supplies the aligned data to the polarity control signal generator 12. Also, the timing controller 8 generates the data control signals DCS and the gate control signals GCS using external synchronizing signals DCLK, DE, Hsync and Vsync so as to control the data driver 4 and the gate driver 6.

The common voltage generator 10 generates the common voltage Vcom and supplies the generated common voltage to the common electrode of the LCD panel 2.

The polarity control signal generator 12 compares the image data Data for the unit of frame with previously set pattern data and maintains or converts the polarity control signal SPOL in accordance with the compared result. Also, the image data Data are supplied to the data driver 4 to synchronize with output timing of the polarity control signal SPOL. The polarity control signal generator 12 may compare all the image data for the unit of frame with one another or may compare only data of one horizontal line with one another.

Figure 4:
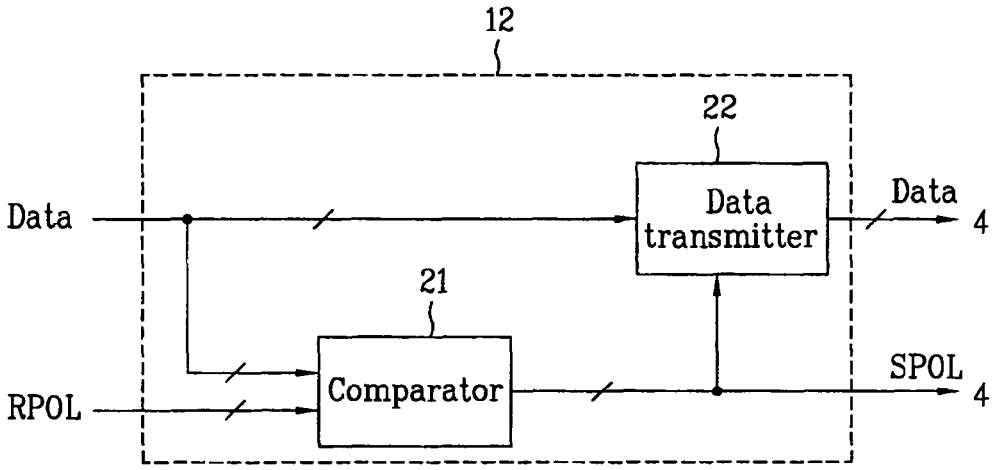
FIG. 4 is a schematic view illustrating a polarity control signal generator shown in FIG. 3.

FIG. 4 is a schematic view illustrating the polarity control signal generator shown in FIG. 3.

The polarity control signal generator, as shown in FIG. 4, includes a comparator 21 comparing the image data Data from the timing controller 8 with the previously set pattern data and outputting the polarity control signal SPOL in accordance with the compared result, and a data transmitter 22 supplying the image data Data from the timing controller 8 to the data driver 4 to synchronize with the polarity control signal SPOL from the comparator 21.

The comparator 21 compares the image data Data from the timing controller 8 with the previously set pattern data, and selectively outputs the polarity control signal SPOL including a reference polarity control signal RPOL from the timing controller 8 in accordance with the compared result. In this case, the polarity control signal SPOL is selected by one of 1×1 inversion method, 2×1 inversion method, 1×2 inversion method, and 2×2 inversion method, which are supported by the data driver 8. Also, the reference polarity control signal RPOL is selected by 1×1 inversion method.

The data transmitter 22 supplies the image data Data from the timing controller 8 to the data driver 4 for the unit of either one frame or at least one horizontal line to synchronize with the polarity control signal SPOL.

The data transmitter 22 may not be provided depending on characteristics of the product. For example, if the image data Data from the timing controller 8 are simultaneously supplied to the data driver 4 and the polarity control signal generator 12, the polarity control signal generator 12 generates the polarity control signal SPOL and supplies the generated signal to the data driver 4. In other words, the polarity control signal generator 12 may only be provided to supply the polarity control signal SPOL.

Figure 5:
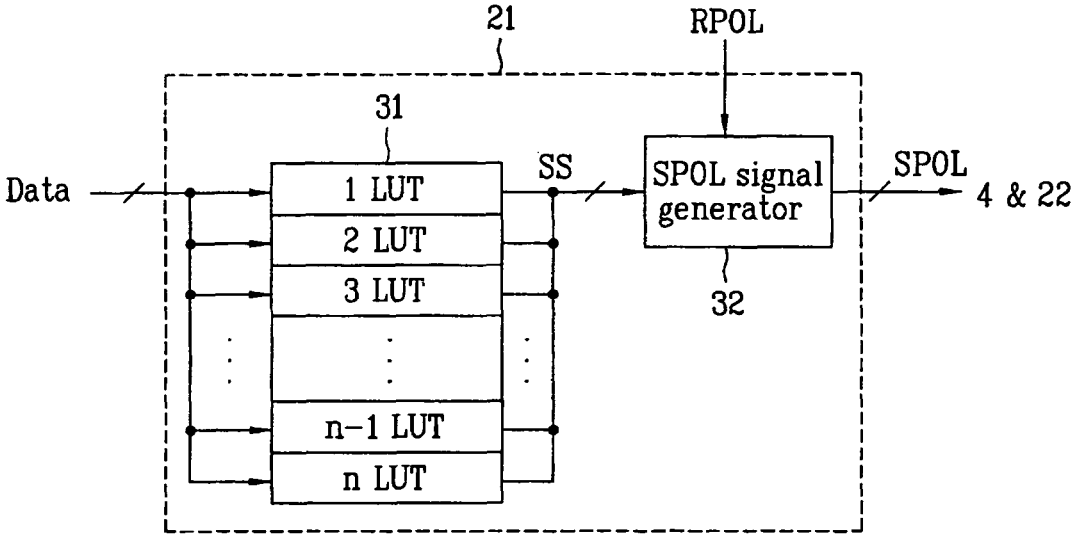
FIG. 5 is a schematic view illustrating a comparator shown in FIG. 4.

FIG. 5 is a schematic view illustrating the comparator shown in FIG. 4.

The comparator 21, as shown in FIG. 5, includes a memory 31 storing a plurality of pattern data in which crosstalk and greenish color occur, and a SPOL signal generator 32 outputting the polarity control signal SPOL in accordance with a synchronizing signal SS from the memory 31.

The memory 31 includes a plurality of look-up tables (first to nth LUTs) storing the plurality of pattern data. The look-up tables (first to nth LUTs) respectively compare the image data with the pattern data and generates the synchronizing signal SS in accordance with the compared result. At this time, pattern data such as gray level value patterns of R, G, B of the image data Data and pixel gray level value patterns of the image data Data are stored in the look-up tables (first to nth LUTs).

Specifically, the pattern data in which crosstalk and greenish occur are stored in the look-up tables (first to nth LUTs), and the input image data Data are compared with the pattern data stored in the look-up tables (first to nth LUTs). At this time, the look-up table where the input image data Data coincide with the pattern data generates the synchronizing signal SS. For example, in a state that pattern data are stored in the second look-up table 2 LUT, wherein the pattern data are arranged in such a manner that R, G, B data having gray level value of 255 and R, G, B data having gray level value of 0 are alternately arranged for the unit of 10 horizontal lines, if the gray level value of the input image data Data is equal to the gray level value stored in the second look-up table 2 LUT, the second look-up table generates the synchronizing signal SS.

Figure 1:
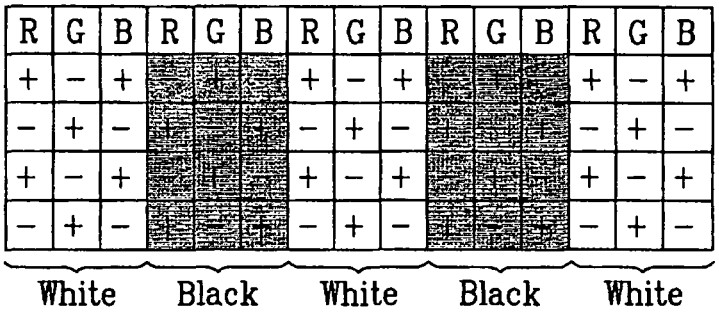
FIG. 1 Related Art
FIG. 1 illustrates a dot inversion driving method.
Figure 2:
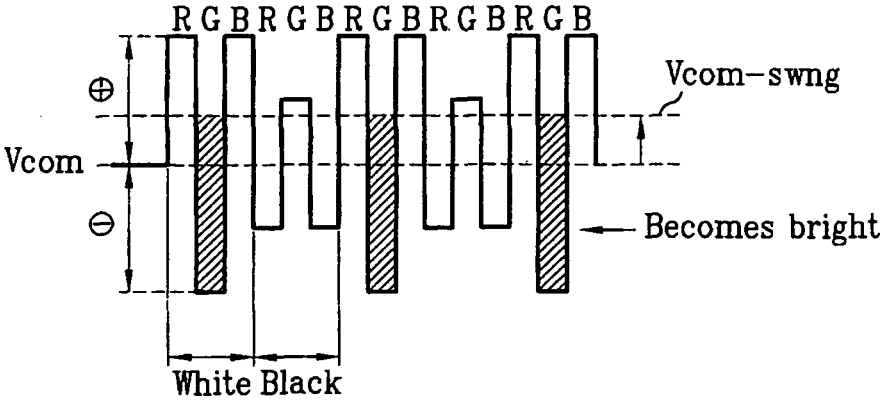
FIG. 2 Related Art
FIG. 2 illustrates a greenish color in a dot inversion driving method.

The SPOL signal generator 32 outputs the polarity control signal SPOL if the synchronizing signal SS is input from the memory 31. In other words, the SPOL signal generator 32 outputs the polarity control signal SPOL selected by one of four driving methods shown in FIGS. 6A to 6D. FIG. 6A illustrates 1×1 inversion driving method, FIG. 6B 2×1 inversion driving method, FIG. 6C 1×2 inversion driving method, and FIG. 6D 2×2 inversion driving method.

For example, the SPOL signal generator 32 supplies the signal selected by the 1×1 inversion driving method shown in FIG. 6A to the data driver 4 in accordance with the reference polarity control signal RPOL input from the timing controller 8. Afterwards, if the synchronizing signal SS is input from the memory 31, the SPOL signal generator 32 outputs the signal selected by the 2×1 inversion driving method shown in FIG. 6B. If the synchronizing signal SS is again input from the memory 31, the SPOL signal generator 32 outputs the signal selected by the 1×2 inversion driving method shown in FIG. 6C. If the reference polarity control signal instead of the synchronizing signal SS is input from the memory 31, the SPOL signal generator 32 repeatedly outputs the signal selected by the 1×1 inversion driving method shown in FIG. 6A.

The data transmitter 22 supplies the image data Data from the timing controller 8 to the data driver 4 for the unit of one frame or at least one horizontal line to synchronize with the polarity control signal SPOL from the SPOL signal generator 32.

The polarity control signal generator 12 according to the present invention, although not shown, may be built in or part of the timing controller 8. Specifically, the timing controller 8 includes the comparator 21 and the data transmitter 22, aligns the external image data RGB to be suitable for driving of the LCD panel 2, and supplies the aligned data to the comparator 21 and the data driver 4. The comparator 4 compares the aligned image data Data with the previously stored pattern data and supplies the resultant polarity control signal SPOL to the transmitter 22 and the data driver 4.

Afterwards, the data driver 4 converts the inversion method of the LCD panel 2 in accordance with the data polarity control signal SPOL and at the same time converts the image data Data into the analog data to supply the analog data to the data lines DL1 to DLm.

As described above, in the apparatus and method for driving an LCD device, the inversion method of the LCD panel is changed depending on the specific pattern of the image data so as to prevent greenish color due to variation of the common voltage from occurring on the LCD panel and also prevent crosstalk from occurring in the specific pattern, thereby improving picture quality of images displayed on the LCD panel.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. An apparatus for driving an LCD device, comprising: an LCD panel;

a memory having pre-stored therein image pattern data for a plurality of patterns; a polarity control signal generator that compares all received image data for a unit of frame with the pre-stored image pattern data of the plurality of patterns for the unit of frame and generates from a reference polarity control signal, a polarity control signal identifying a new inversion method when the received image data coincides with the pre-stored image pattern data for at least one of the plurality of patterns, wherein each of the plurality of pre-stored image pattern data identifies a pattern of the received image data in which crosstalk and greenish color occur due to a difference between a data voltage of positive polarity (+) and a data voltage of negative polarity (−) supplied to one horizontal line;

a data driver configured to receive the polarity control signal and convert an inversion method applied to the LCD panel to the new inversion method identified by the polarity control signal, and further configured to supply the received image data to the LCD panel;

a gate driver that supplies scan pulses to the LCD panel; and a timing controller that controls the data driver and the gate driver.

2. The apparatus as claimed in claim 1, wherein the polarity control signal generator includes:

a comparator that compares the received image data with the pre-stored image pattern data for the plurality of patterns and outputs the polarity control signal or the reference polarity control signal from the timing controller in accordance with the compared result; and a data transmitter that supplies the received image data from the timing controller to the data driver to synchronize with the polarity control signal or the reference polarity control signal.

3. The apparatus as claimed in claim 2, wherein the comparator includes:

a memory that generates a synchronizing signal if the received image data are equal to pre-stored image pattern data for at least one of the plurality of patterns; and a SPOL signal generator that outputs the polarity control signal in accordance with the synchronizing signal.

4. The apparatus as claimed in claim 3, wherein the polarity control signal is one of 1×1 inversion control signal, 2×1 inversion control signal, 1×2 inversion control signal, and 2×2 inversion control signal.

5. The apparatus as claimed in claim 3, wherein the memory includes a plurality of look-up tables that store the pre-stored image pattern data, respectively.

6. The apparatus as claimed in claim 5, wherein each of the plurality of look-up tables correspond to a generated synchronizing signal if the image data are equal to pre-stored image pattern data for at least one of the plurality of patterns after the image data are compared with the pre-stored image pattern data of the plurality of patterns.

7. The apparatus as claimed in claim 1, wherein the polarity control signal generator is part of the timing controller.

8. A method for driving an LCD device, comprising:

pre-storing image pattern data for a plurality of patterns, wherein each image pattern data of the plurality of patterns identifies a pattern of input image data in which crosstalk and greenish color occur due to a difference between a data voltage of positive polarity (+) and a data voltage of negative polarity (−) supplied to one horizontal line;

comparing all input image data for a unit of frame with the pre-stored image pattern data of the plurality of patterns for the unit of frame and generating a synchronizing signal when the input image data coincides with the image pattern data for at least one of the plurality of patterns;

generating from a reference polarity control signal, a polarity control signal identifying a new inversion method in accordance with the synchronizing signal; and outputting the input image data synchronized with the polarity control signal identifying the new inversion method.

9. The method as claimed in claim 8, wherein the step of generating the synchronizing signal includes generating the synchronizing signal if the input image data are equal to the pre-stored image pattern data for at least one of the plurality of patterns.

10. The method as claimed in claim 8, wherein the step of comparing the input image data with the pre-stored image pattern data of the plurality of patterns includes comparing the input image data with the pre-stored image pattern data of the plurality of patterns for a unit of frame.

11. The method as claimed in claim 8, wherein the step of generating the polarity control signal includes generating the polarity control signal if the synchronizing signal is generated.

12. The method as claimed in claim 11, wherein the polarity control signal is one of 1×1 inversion control signal, 2×1 inversion control signal, 1×2 inversion control signal, and 2×2 inversion control signal.

13. An apparatus for driving an LCD device, comprising:

an LCD panel having a plurality of gate lines and data lines;

a gate driver that drives the gate lines;

a data driver that drives the data lines;

a timing controller that controls the data driver and the gate driver;

a memory having pre-stored therein image pattern data for a plurality of patterns; a control signal generator that receives image data from the timing controller and compares all the received image data for a unit of frame with pre-stored image pattern data of the plurality of patterns for the unit of frame, and generates from a reference polarity control signal, a polarity control signal identifying a new inversion method when the received image data coincides with the pre-stored image pattern data for at least one of the plurality of patterns, wherein each of the pre-stored image pattern data for the plurality of patterns identifies a pattern of the received image data in which crosstalk and greenish color occur due to a difference between a data voltage of positive polarity (+) and a data voltage of negative polarity (−) supplied to one horizontal line; and wherein the data driver converts an inversion method to the new inversion method identified by the polarity control signal.

* * * * *